US005967849A

United States Patent [19]

Shiga et al.

[11] Patent Number: 5,967,849

[45] Date of Patent: Oct. 19, 1999

[54] CONNECTOR DEVICE AND CONTACT RETENTION STRUCTURE THEREFOR

[75] Inventors: Katsumi Shiga, Chia; Takayuki Minematsu, Kanagawa, both of Japan

[73] Assignee: The Whitaker Corporation, Wilmington, Del.

[21] Appl. No.: 08/915,890

[22] Filed: Aug. 21, 1997

[30] Foreign Application Priority Data

Aug. 29, 1996 [JP] Japan ..... 8-228507

[51] Int. Cl.[6] ..... H01R 25/00

[52] U.S. Cl. ..... 439/654

[58] Field of Search ..... 439/654, 638, 439/628, 652, 656, 721, 723, 724, 718, 639, 750, 787

[56] References Cited

U.S. PATENT DOCUMENTS 4,854,899 8/1989 Matthews ..... 439/724

5,123,859 6/1992 Davis et al. ..... 439/654

5,372,525 12/1994 Wu et al. ..... 439/656

*Primary Examiner*—Paula Bradley

*Assistant Examiner*—Tho D. Ta

*Attorney, Agent, or Firm*—Bradley N. Ditty

[57] ABSTRACT

A plurality of wires 4 are linearly disposed along the direction of length of a long slender insulating support 2, and contacts 6 are formed as terminals on both ends of each wire. The contacts 6 are symmetrically disposed on the outer periphery of the long slender insulating support 2 while being prevented from slipping out by means of checking engagement parts or shoulders 21 which are provided at both ends of the long slender insulating support 2, and which prevent slipping out in the direction of length. Frame-form bodies or caps 8 are disposed on the outer peripheries of the contacts 6 so that these frame-form bodies 8 engage with all of the plurality of contacts 6 and the contacts 6 abnd caps 8 can shift axially to facilitate connedction to another component.

17 Claims, 5 Drawing Sheets

CONNECTOR DEVICE AND CONTACT RETENTION STRUCTURE THEREFOR

BACKGROUND OF THE INVENTION

1. Field of the Invention

The present invention concerns a connecting device that connects parts driven by electricity to a connector unit. More specifically, the present invention concerns (a) a connector connecting device which is mounted in a holding part such as an aluminum die casting, etc., that holds, for example, a driving part such as a motor or the like together with an electrical connector unit mounted in an automobile, etc., and which electrically connects the driving part to the connector unit, and (b) a contact holding structure which constitutes a part of this connector connecting device.

2. Description of the Prior Art

Driving parts such as motors or the like which are mounted in automobiles, etc., are connected to power supplies and control parts via harnesses which include electrical connectors. In order to insure a secure and stable electrical connection in such cases, holding parts such as aluminum die castings, etc., which hold the driving parts together with connector units are used, and the harnesses described above are installed in these holding parts such as aluminum die castings, etc.

However, in the case of connections made using such harnesses, the efficiency of assembly and connection work is poor; accordingly, there has been a demand for a change to connector connecting devices. In such connector connecting devices, the die casting is equipped with an attachment means which is used to attach the driving part such as a motor, etc.; accordingly, it is desirable that accommodation in as small a space as possible be achievable. Furthermore, easy assembly is also desirable. Moreover, it is desirable that there be some degree of play in the contacts at both ends in order to facilitate connection with the objects being connected.

SUMMARY OF THE INVENTION

In response to such demands, one object of the present invention is to provide a connector connecting device in which assembly is facilitated and simplified while a compact shape which can be accommodated in a small space is maintained so that assembly and manufacture are facilitated, and in which connection work is also simplified.

Furthermore, another object of the present invention is to provide a contact holding structure for the purpose of realizing the connector connecting device described above.

The connector connecting device of the present invention comprises a long slender insulating support, a plurality of wires which are linearly disposed on the long slender insulating support along the direction of length of the long slender insulating support, a plurality of contacts which are symmetrically disposed on the outer periphery of the long slender insulating support and which are prevented from slipping out by an engagement means which is provided in the long slender insulating support and which prevents slipping out in the direction of length, and frame-form bodies which are disposed on the outer peripheries of the plurality of contacts so that the frame-form bodies engage with all of the plurality of contacts.

Furthermore, the contact holding structure of the connector connecting device described above comprises a long slender insulating support, a plurality of contacts which are symmetrically disposed on the outer periphery of the long slender insulating support in the vicinity of one end of the support so that the movement of the contacts in the direction of length is restricted, and frame-form bodies or caps which are disposed on the outer peripheries of the plurality of contacts so that the frame-form bodies or caps engage with all of the plurality of contacts.

In other words, the present invention is characterized by the fact that contacts formed as terminals at both ends of a plurality of wires disposed linearly along the direction of length of a long slender insulating support are symmetrically disposed on the outer periphery of the long slender insulating support, and the device is designed so that the wires and contacts are prevented from slipping out in the axial direction by an engagement means which is provided in the long slender insulating support and which prevents slipping out in the axial direction, while frame-form bodies are engaged only with the outer peripheries of the plurality of contacts on the long slender insulating support so that a certain degree of play in the positions of the contacts is obtained as a result of play in the wires.

In the connector connecting device of the present invention, contacts formed as terminals at both ends of a plurality of wires disposed linearly along the direction of length of a long slender insulating support are symmetrically disposed on the outer periphery of the long slender insulating support; accordingly, the connector connecting device of the present invention can be accommodated in a small space.

Furthermore, the device can be assembled merely by causing frame-form bodies or caps to engage with the outer peripheries of the plurality of contacts on the long slender insulating support while using an engagement means which is provided in the long slender insulating support, and which prevents slipping out in the axial direction, to prevent the wires and contacts from slipping out in the direction of length; accordingly, assembly work is facilitated and simplified, so that assembly and manufacture are facilitated.

Furthermore, the device is designed so that the frame-form bodies are caused to engage only with the outer peripheries of the plurality of contacts on the long slender insulating support, thus allowing a certain amount of movement of the contacts together with the wires in the axial direction, so that a certain degree of play in the positions of the contacts is obtained as a result of play in the wires. Accordingly, the contacts can easily be disposed in positions appropriate for engagement, so that connection work is facilitated.

DETAILED DESCRIPTION OF THE PREFERRED EMBODIMENT

Figure 1:
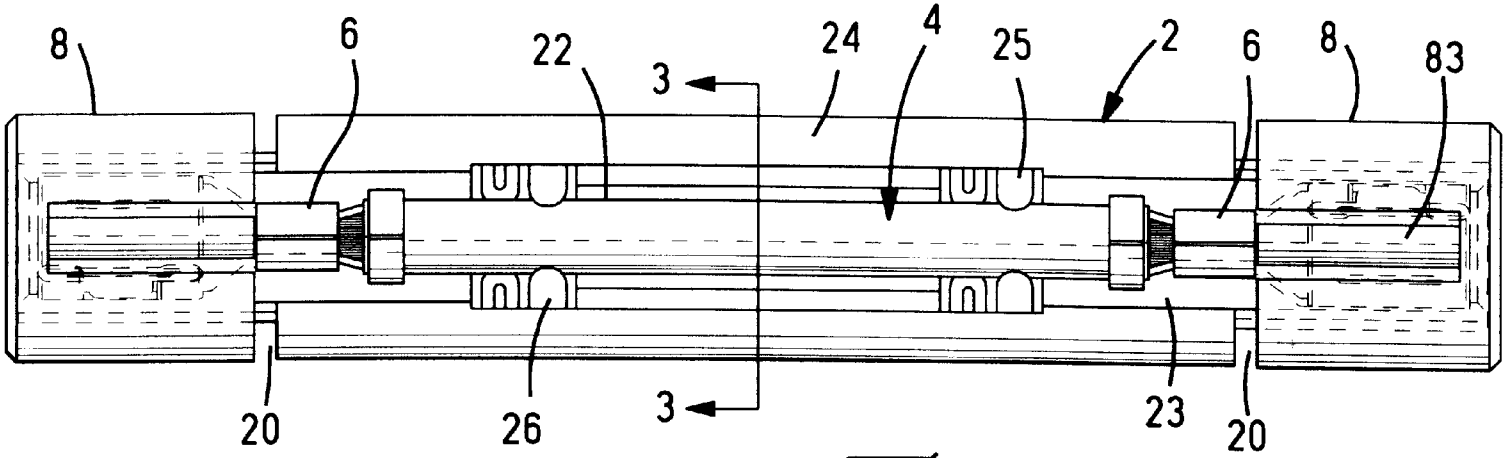
FIG. 1 is a front view that illustrates a connector connecting device constructed according to one working configuration of the present invention.
Figure 2:
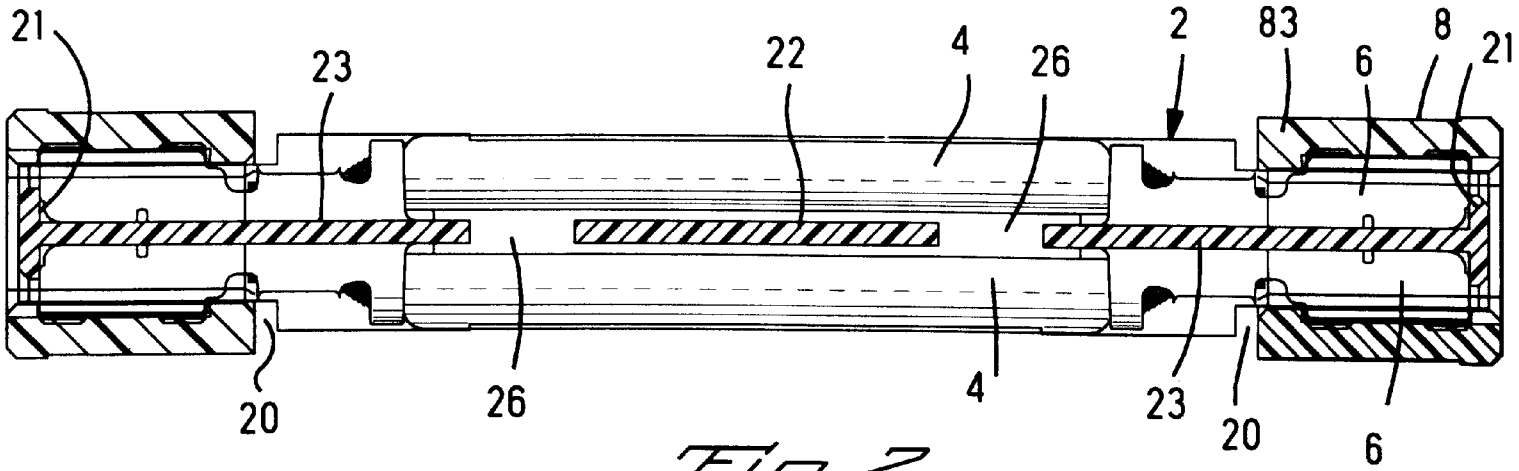
FIG. 2 is a horizontal sectional view of the same.
Figure 3:
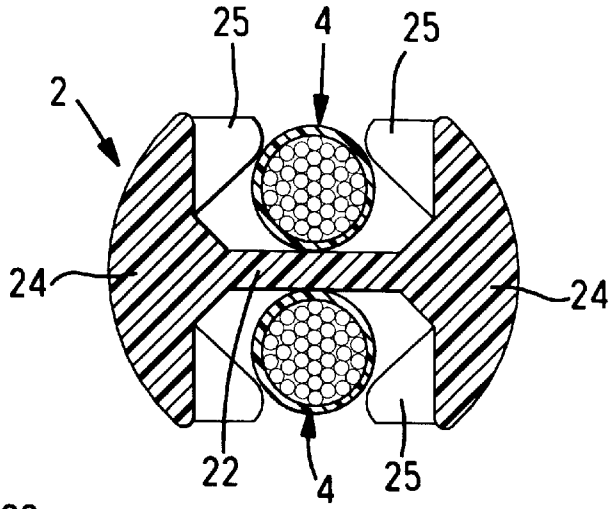
FIG. 3 is a sectional view along line 3—3 that passes vertically through the center of FIG. 1.
Figure 4:
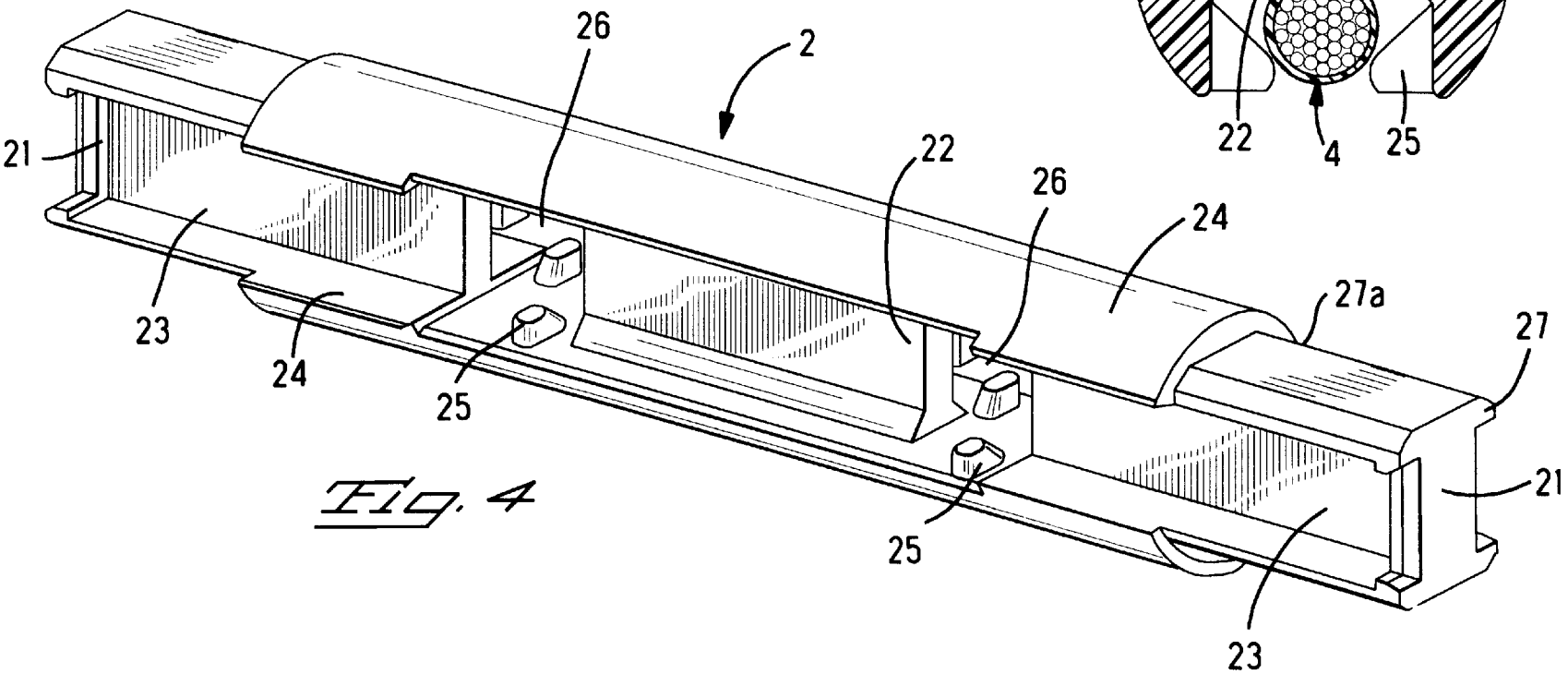
FIG. 4 is a perspective view that illustrates the long slender insulating support of the connector connecting device of this working configuration.
Figure 5:
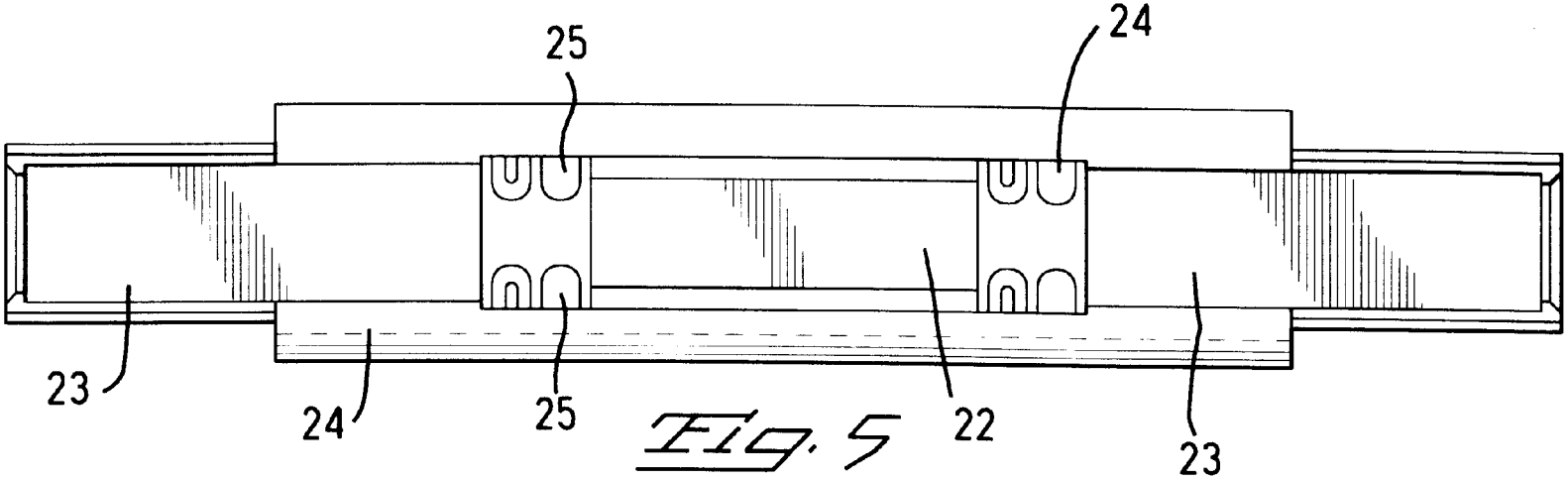
FIG. 5 is a front view of the same.
Figure 6:
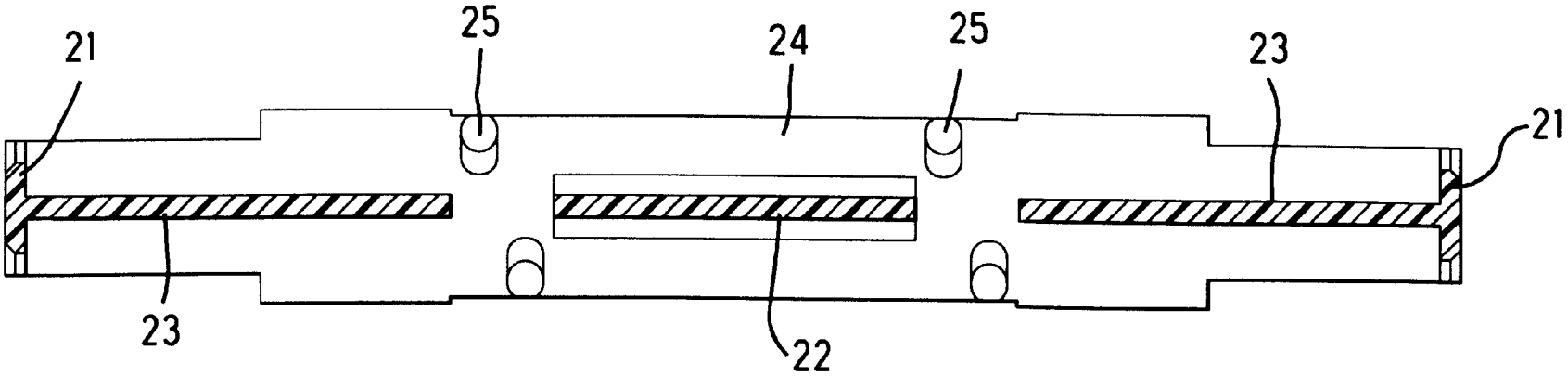
FIG. 6 is a horizontal sectional view of the same.
Figure 7:
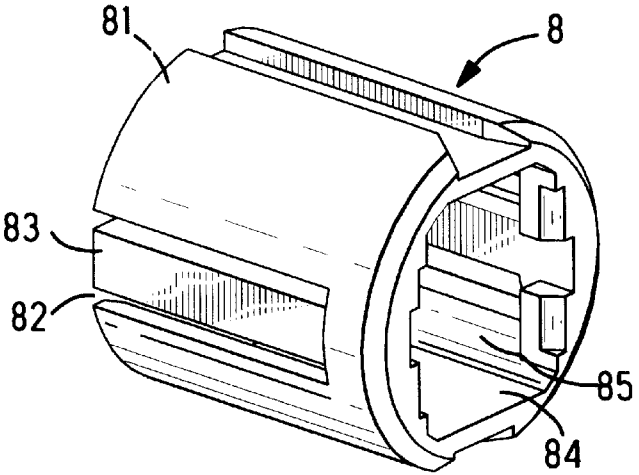
FIG. 7 is a perspective view that illustrates one of the frame-form bodies or caps of the connector connecting device of this working configuration.
Figure 8:
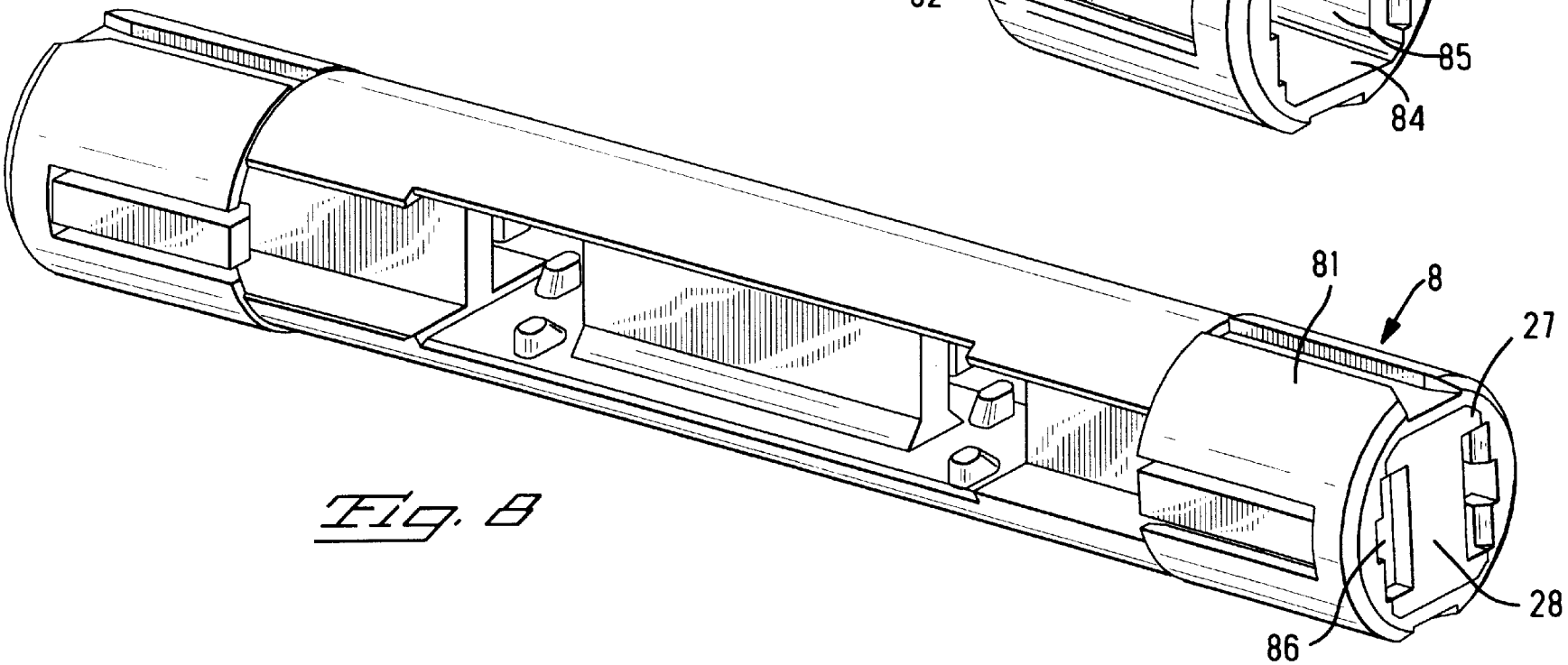
FIG. 8 is a perspective view that shows how the frame-form bodies (one of which is shown in FIG. 7) are disposed on both ends of the long slender insulating support shown in FIG. 4.
Figure 9:
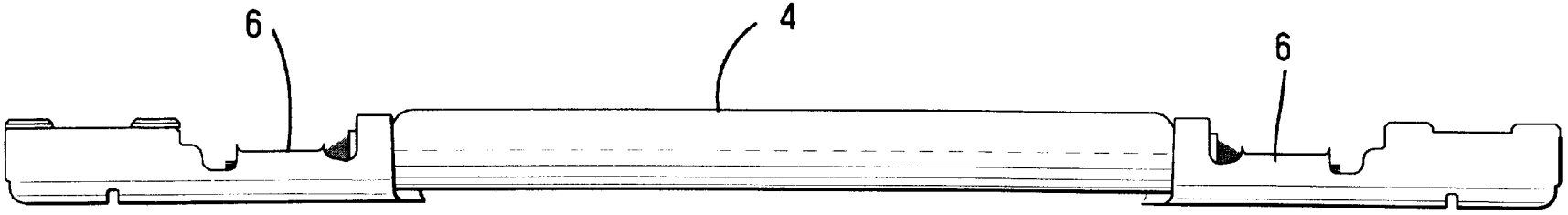
FIG. 9 is a plan view that shows only one of the wire-contact assemblies mounted in the connector connecting device of the present working configuration.
Figure 10:
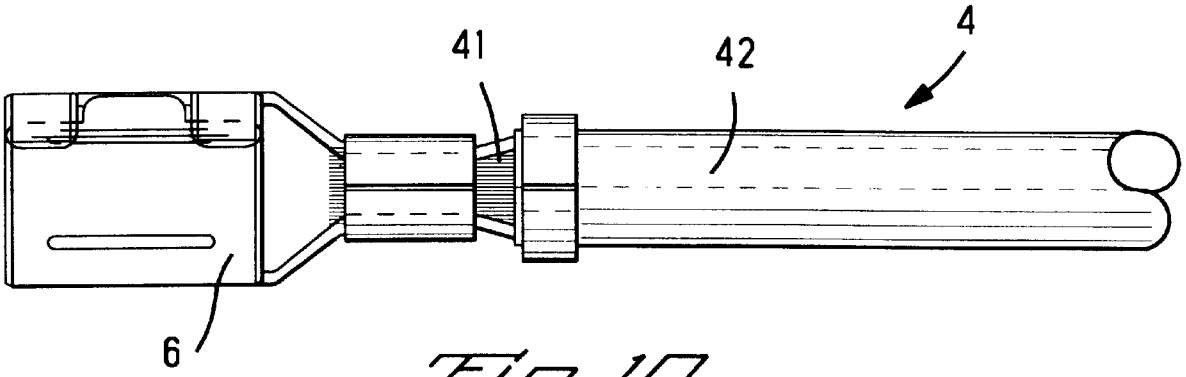
FIG. 10 is a partial front view that shows one end of this wire-contact assembly.

Below, working configurations of the connector connecting device of the present invention and the contact holding structure of this connector connecting device will be described with reference to the attached figures. FIG. 1 is a front view that illustrates a connector connecting device constructed according to one working configuration of the present invention. FIG. 2 is a horizontal sectional view of the same, and FIG. 3 is a sectional view along line III—III in FIG. 1. FIG. 4 is a perspective view that illustrates the long slender insulating support of the connector connecting device of this working configuration. FIG. 5 is a front view of the same. FIG. 6 is a horizontal sectional view of the same. FIG. 7 is a perspective view that illustrates one of the frame-form bodies of the connector connecting device of this working configuration. FIG. 8 is a perspective view which shows how the frame-form bodies (one of which is shown in FIG. 7) are disposed on both ends of the long slender insulating support shown in FIG. 4. FIG. 9 is a plan view which shows only one of the wire-contact assemblies mounted in the connector connecting device of the present working configuration. FIG. 10 is a partial front view that shows one end of this wire-contact assembly.

As is shown in FIGS. 1 and 2, the connector connecting device constituting the above working configuration of the present invention is basically constructed as follows: i. e., two wires 4 are linearly disposed (in a state in which the wires 4 are insulated from each other) on both sides of a long slender insulating support 2 along the direction of length of this long slender insulating support. Contacts 6, formed as terminals at both ends of each wire 4, are symmetrically disposed on the outer periphery of the long slender insulating support 2 while being prevented from slipping out by a means which prevents slipping out in the direction of length (described later), this means being provided in the long slender insulating support 2. Furthermore, frame-form bodies 8 which engage with all of the plurality of contacts 6 are disposed on the outer peripheries of the contacts 6.

Specifically, in the long slender insulating support 2, as is clearly shown in FIGS. 1, 2, 4, 5 and 6, a central partition plate 22 which extends in the direction of length is formed as an integral part (in the center with respect to the direction of width of the insulating support) between a pair of upper and lower outer walls 24 whose outer surfaces are cylindrical surfaces. Furthermore, checking engagement parts or shoulders 21 which are T-shaped in the horizontal section at the outer ends are formed so that these engagement parts or shoulders 21 extend integrally outward in the direction of length from both end portions of both outer walls 24, and a pair of end partition plates 23 which are I-shaped in cross section are formed so that these end partition plates extend on lines extending from the central partition plate 22. Furthermore, pairs of projections 25 which prevent the two wires 4 from slipping out in the radial direction are formed on the inside surfaces of the outer walls 24 in the respective spaces on both sides which are separated by the partition plates 22 and 23. As is shown most clearly in FIG. 4, gaps 26 are formed between the partition plates 22 and 23 of this long slender insulating support 2.

As is shown in FIGS. 1, 2 and 3, the two wires 4 are linearly disposed (in a state in which the wires are insulated from each other) to the inside of the projections 25 in the respective spaces on both sides which are separated by the partition plates 22 and 23, and contacts 6 are formed as terminals on both ends of each of these wires 4. FIG. 9 shows an assembly consisting of one of the wires 4 (which has the contacts 6 formed as terminals on both ends) and the corresponding contacts 6. FIG. 10 shows one end of this assembly only. Furthermore, as is shown in FIG. 10, the wires 4 are wires in which numerous conductors 41 are gathered into a bundle, and the outer surface of this bundle is covered by an insulating covering 42. In this assembly consisting of a wire 4 and contacts 6, the tips of the contacts 6 contact the checking engagement parts or shoulders 21 of the long slender insulating support 2 so that the contacts 6 are supported on the long slender insulating support 2 in a manner which prevents the contacts 6 from shifting in the axial direction.

Frame-form bodies or caps 8 are engaged with the outer peripheries of the plurality of contacts 6 so that these frame-form bodies 8 engage with all of the plurality of contacts 6. As is shown in an enlargement in FIG. 7, each of the frame-form bodies 8 consists overall of a cylindrical main body 81. Openings 82 which extend in the axial direction, and cantilever elastic leaves or beams 83 which extend in the axial direction within the openings 82, and which are supported at one end as integral parts of the main body 81, are formed in portions of the main body 81. As is shown in FIG. 2, the inside of each elastic leaf or beam 83 has a shape which engages in the forward-rearward direction (at both ends in the direction of length) with the outline shape of the outward-facing side of the corresponding contact 6, so that the contacts 6 and frame-form bodies 8 are engaged in a manner that prevents these parts from shifting relative to each other in the direction of length.

Furthermore, as is clear from FIGS. 4, 7 and 8, the outer surfaces 27*a* of the upper and lower protruding parts 27 of the cross-sectionally I-shaped end partition plates 23 of the long slender insulating support 2 engage with the inside wall surfaces 84 of the main bodies 81 of the frame-form bodies 8 (see FIG. 7) in a manner which allows sliding, so that the frame-form bodies or caps 8 can be freely moved in the direction of length while being guided along the protruding parts 27 of the end partition plates 23. Since the contacts 6 and frame-form bodies 8 are engaged so that these parts cannot shift relative to each other in the direction of length, the contacts 6 and frame-form bodies 8 can be moved as a unit in the direction of length. However, since the inner ends of the frame-form bodies 8 face the outer ends of the outer walls 24 of the long slender insulating support 2 across slight gaps 20 (see FIGS. 1 and 2), only an amount of movement equal to these gaps 20 is permitted. As a result of this movement in the direction of length, a certain amount of play is insured at the time of connection, so that connection work is facilitated.

Furthermore, as is shown in FIG. 8, insertion holes 86 for insertion of the contacts of mating connectors are formed between the end surfaces 28 of the end partition plates 23 of the long slender insulating support 2, and the edges of the openings 85 of the main bodies 81 of the frame-form bodies 8 (see FIG. 7).

The connector connecting device of the present invention has a small overall size and requires little space for installation. Furthermore, assembly can be accomplished merely by mounting the wire-contact assemblies on the long slender insulating support 2, and fitting the cap-shaped frame-form bodies 8 over both ends. Accordingly, assembly is easy.

Furthermore, the working configuration described above merely illustrates one example of a connector connecting device constructed according to the concept of the present invention. It goes without saying that various alterations may be made without losing the effect of the present invention. For example, the number of wires 4 used is not limited to two wires; three or four wires, or an even greater number of wires, may be used.

We claim:

1. Apparatus for connecting an electrical component to a separate component, the apparatus comprising:

multiple wires, each wire having an electrical contact attached at each end thereof;

an insulating support, the wires being positioned on the insulating support, with contacts located at each end of the insulating support;

at least one shoulder on each end of the insulating support protruding from the insulating support to engage a corresponding contact to prevent axial movement of the corresponding contact in one direction; and a cap located at each end of the insulating support, each cap engaging the contacts at the corresponding end of the insulating support, each cap and the corresponding contacts engaged by the cap being axially shiftable relative to the insulating support for a limited axial distance to permit axial movement of the contacts to facilitate connection of the apparatus to the components;

wherein the insulating support includes outer walls having axial ends spaced inwardly from the ends of the insulating support, the axial end of the outer walls abutting corresponding caps upon inward axial movement of the caps so that abutment between the caps and the outer walls limits inward movement of the caps and the corresponding contacts.

2. The apparatus of claim 1 wherein the insulating support is longer than the wires.

3. The apparatus of claim 1 wherein the axial end of each outer wall is spaced from the corresponding end of the insulating support by a distance sufficient to permit limited movement of the cap relative to the insulating support.

4. The apparatus of claim 1 wherein each cap engages both ends of the corresponding contacts.

5. The apparatus of claim 1 wherein insertion holes are formed between each cap and the corresponding end of the insulating support to permit insertion of mating connector contacts.

6. The apparatus of claim 1 wherein the insulating support includes means for securing the wires to the insulating support.

7. The apparatus of claim 1 wherein the insulating support and the caps on each end thereof form a slender cylindrical assembly.

8. An apparatus for supporting a plurality of wires with contacts attached to the wires on opposite ends thereof adjacent opposite ends of the apparatus comprising:

an insulating support;

means for securing the wires to the insulating support;

a cap located on at least one end of the insulating support, the cap being secured to the contacts on the corresponding end of the insulating support; and a gap formed between the cap and the insulating support to permit limited axial movement of the cap and the contacts relative to the insulating support to facilitate connection of the contacts to a mating connector.

9. The apparatus of claim 8 wherein the cap includes an elastic beam engagable with a corresponding contact to secure the cap to the contacts.

10. The apparatus of claim 8 wherein caps are located at opposite ends of the insulating support and the caps are each secured to corresponding contacts on opposite ends of wires.

11. The apparatus of claim 8 wherein the insulating support is configured so that the wires can be mounted on the insulating support before a cap is mounted thereon, the cap being insertable over the end of the insulating support into engagement with corresponding contacts on the corresponding end of the insulating support.

12. The apparatus of claim 8 wherein the caps are secured to the contacts only on an outer periphery of each contact.

13. The apparatus of claim 10 wherein the insulating support includes a central partition plate extending between contacts located at both ends of the wires and end partition plates located at opposite ends of the insulating support, the caps surrounding the end partition plates with contacts located between the end partition plates and the caps.

14. The apparatus of claim 13 wherein the end partition plates have an I-shaped cross section.

15. The apparatus of claim 13 wherein projections spaced from the central partition secure the wires between the central partition and the projections to prevent radial movement of the wires.

16. The apparatus of claim 13 wherein each end partition plate includes an engagement part on the end thereof, the engagement part abutting the contacts on the corresponding end of the insulating support to limit axial movement of the contacts and the cap in one axial direction.

17. The apparatus of claim 16 wherein the central partition plate joins upper and lower outer walls, the upper and lower outer walls abutting the caps at each end of the insulating support to limit axial movement of the contacts and the cap in a second axial direction.

* * * * *